United States Patent [19]

Chang et al.

[11] 4,112,695

[45] Sep. 12, 1978

[54] SEA SLED FOR ENTRENCHING PIPE

[75] Inventors: Nuke Ming Chang; Elmer R. Remkes, both of Orange, Calif.; William Cook, Jr., Houma, La.

[73] Assignee: Santa Fe International Corp., Orange, Calif.

[21] Appl. No.: 773,015

[22] Filed: Feb. 28, 1977

[51] Int. Cl.[2] ..... E02F 5/02; F16L 1/00

[52] U.S. Cl. ..... 405/163; 37/63

[58] Field of Search ..... 61/72.4; 37/63, 81, 37/54, 65, 64

[56] References Cited

U.S. PATENT DOCUMENTS

| | | | |
|---|---|---|---|
| 3,877,238 | 4/1975 | Chang et al. | 61/72.4 |
| 3,926,003 | 12/1975 | Norman | 61/72.4 |
| 4,022,028 | 5/1977 | Martin | 61/72.4 |

*Primary Examiner*—Jacob Shapiro
*Attorney, Agent, or Firm*—LeBlanc & Shur

[57] ABSTRACT

The sea sled includes a pair of pontoons mounting depending rollers for straddling a pipeline disposed on the sea bottom. Water jets fluidize the sea bottom to form a trench in which the pipeline settles. The slurry formed by the water jets is removed from the trench by the eductor system which includes a pair of conduits each having a suction inlet at its lower end for location within the trench, a discharge at its upper end, a pair of pump nozzles each having an inlet external to the associated conduit and an outlet within the conduit directed toward the corresponding discharge, and a pair of primary nozzles, the outlet ends of which respectively project into the inlet ends of the pump nozzles. A high pressure, low volume, fluid is pumped from the surface through the jet nozzles. Ambient fluid is entrained with the high pressure, low volume fluid emanating from the jet nozzles in the respective pump nozzles to deliver low pressure, high volume fluid to their corresponding discharges. The action of the pump nozzles in the conduits creates a suction whereby the slurry from the trench is pumped from the trench through the conduits and discharged to opposite sides of the trench.

63 Claims, 13 Drawing Figures

SEA SLED FOR ENTRENCHING PIPE

BACKGROUND OF THE INVENTION

The present invention relates to a sea sled for entrenching and burying undersea pipeline and particularly relates to an eductor system for removing slurry from the trench whereby pipeline laid along the sea bottom settles into the trench.

Various systems for laying pipelines along the sea bottom have been proposed and utilized in the past, (see, for example, U.S. Pat. No. 3,751,927). Certain of these systems provide a sea sled having jet nozzles directed to fluidize the sea bottom and form a trench for receiving the pipeline. Air jet type eductor systems have also been provided for removing the cuttings or slurry formed by the jet nozzles from the trench. Such air jet eductor systems usually comprise a nozzle disposed in the inlet end of a discharge conduit with air being supplied under pressure from a surface floating tender. Air jet eductor systems are very efficient and will lift significant quantities of slurry. However, with the increasing necessity to lay pipelines in deeper water, for example in water depths exceeding 150–200 feet, an air jet educto system becomes uneconomical. That is, as the water depth increases, the horsepower requirements to supply compressed air from the surface increase quite rapidly.

U.S. Pat. No. 3,877,238, issued Apr. 15, 1975 and commonly assigned with the present invention, describes an improved sea sled for entrenching and pipe burying operations which has been found to successfully overcome problems associated with prior art devices in deep water operations. The present invention constitutes an improvement upon the sea sled and eductor system described in the U.S. Pat. No. 3,877,238 in that it better utilizes energy available from the high pressure, low volume fluid source pumped from a surface floating vessel and in that slurry is discharged from the eductor pipes in such a way as to more effectively avoid filling the trench with spoil before the pipe has a chance to settle.

The present invention provides a novel and improved sea sled and eductor system for forming a trench and for burying underwater pipelines, particularly in depths beyond the feasible or practical limits of presently available air operated equipment, which minimizes or eliminates problems associated with prior sea sled and eductor systems and provides a novel and improved sea sled and eductor system having various advantages in construction, mode of operation and use in comparison with such prior sea sleds and eductor systems. In considering the problem of entrenching and burying pipelines in deeper water, for example, in water depths beyond 200 feet, a water jet eductor system was proposed to overcome the problems associated with prior air jet systems and also in order to utilize an available low volume high pressure supply for the eductor. Upon further consideration, however, it was found that utilization of a high pressure water jet would give rise to severe cavitation problems in the throat and mixing region of the eductor conduit. In short, while a high pressure water jet could be utilized, the eductor system per se would have an extremely shoft life as cavitation effects would destroy the efficiency of the system as well as the equipment itself. Reduced flow rates and pressures from the high pressure water jet were rejected as solutions to the cavitation problem for a number of reasons including the desirability of obtaining a significant predetermined flow rate of slurry removal from the trench.

Accordingly, it is a primary object of the present invention to provide a novel and improved sea sled and eductor system for entrenching and burying underwater pipelines.

It is another object of the present invention to provide a novel and improved sea sled and eductor system for entrenching and burying underwater pipelines in deep water, for example, on the order of 200 feet or more.

It is still another object of the present invention to provide a novel and improved eductor system for burying subsea pipelines.

It is a further object of the present invention to provide a novel and improved sea sled and eductor system for entrenching and burying subsea pipelines utilizing a novel and improved two stage jet pump configuration for suctioning the slurry from the trench in which the pipeline is to be laid.

It is still a further object of the present invention to provide a nozzle and improved sea sled and eductor system for entrenching and burying subsea pipelines in which slurry is discharged in a direction substantially parallel to the sea bottom to decrease the settling time and increase the distance which slurry is cast from the excavation, to thereby minimize the transport of spoil back to the trench.

These and further objects and advantages of the present invention will become more apparent upon reference to the following specification, appended claims and drawings.

SUMMARY OF THE INVENTION

In accordance with the present invention, the problems of economically removing the slurry from a trench in water depths exceeding about 200 feet and of cavitation associated with utilization of high pressure water jet nozzle are overcome by providing an eductor system having a double nozzle arrangement. Particularly, the present eductor system provides a pair of suction conduits mounted on a framework to straddle the pipe to be entrenched. Each suction conduit has an inlet at its lower end for receiving the slurry from the trench and a discharge or eductor conduit section at its other end for discharging the slurry into the ambient water astride the trench. The eductor conduit is located to discharge slurry in a direction substantially parallel to the sea bottom or either side of the trench.

An inner pump nozzle is disposed in each conduit and has an inlet external to the conduit, the inlet being exposed to the ambient water. The outlet of each pump nozzle is disposed within the eductor conduit in a direction toward the conduit discharge. A pair of outer jet nozzles are carried by the sea sled and are mounted coaxially with and behind the inner pump nozzles. Each jet nozzle is located such that its outlet protrudes into the inlet of a corresponding pump nozzle. Each jet nozzle is provided with high pressure, low volume fluid from the surface floating tender. This fluid flows outwardly from the jet nozzle into the larger diameter corresponding pump nozzle to create a low pressure region in the pump nozzle which draws the ambient fluid toward the inlet of the pump nozzle. The jet flow entrains the ambient fluid for delivery through the pump nozzle at low pressure, high volume, into the eductor conduit. This low pressure, high volume, fluid delivery to each eductor conduit creates a suction at the inlets of the conduits whereby slurry from the trench is sucked into the suction conduit, the entrained fluid and slurry being discharged through the eductor conduit. By permitting the high pressure, low volume, jet to expand in the pump nozzle, full use is made of the high energy available in the jet while reducing the pressure and at the same time increasing the flow rate into the primary jet nozzle; there is thus a consequent reduction in the tendency of the eductor conduit to pit as a result of cavitation pressures. It has been found that by utilizing a high pressure, low volume, fluid source pumped from a surface floating tender through each jet nozzle, a low pressure, high volume, condition occurs through the corresponding pump nozzle which, in turn, creates a satisfactory magnitude of suction at the eductor inlets for removal of the slurry.

As will be appreciated from a comparison of the present invention with that described in the U.S. Pat. No. 3,877,238, the present invention contains improvements which, while not detracting from the advantages over previous entrenching device achieved by the U.S. Pat. No. 3,877,238 sled, further improves on the ability to effectively entrench and bury pipes in a deep water environment. It will be seen, for example, that the U.S. Pat. No. 3,877,238 sled discharges slurry from the eductor outlets at approximately a 45° angle relative to the sea bottom. The present invention discharges slurry in a direction substantially parallel to the sea bottom; the effect of this is to substantially minimize the transport of material back to the excavation site. Also, by increasing the deflection angle between the eductor intake and discharge sections from 45° to 90°, slurry is cast further from the excavation with a shorter settling time.

A second distinction resides in the jet pump construction. In the U.S. Pat. No. 3,877,238 sled, the primary nozzle outlet is adjustably spaced from the pump nozzle inlet a distance on the order of approximately 2 to 30 inches, depending upon such parameters as depth of water, nozzle configuration, etc. In the present invention, the jet nozzle outlet is located within the pump nozzle inlet to substantially reduce losses of potentially useful energy and to make full use of the available energy in the pump supply fluid.

DESCRIPTION OF THE PREFERRED EMBODIMENT

Figure 1:
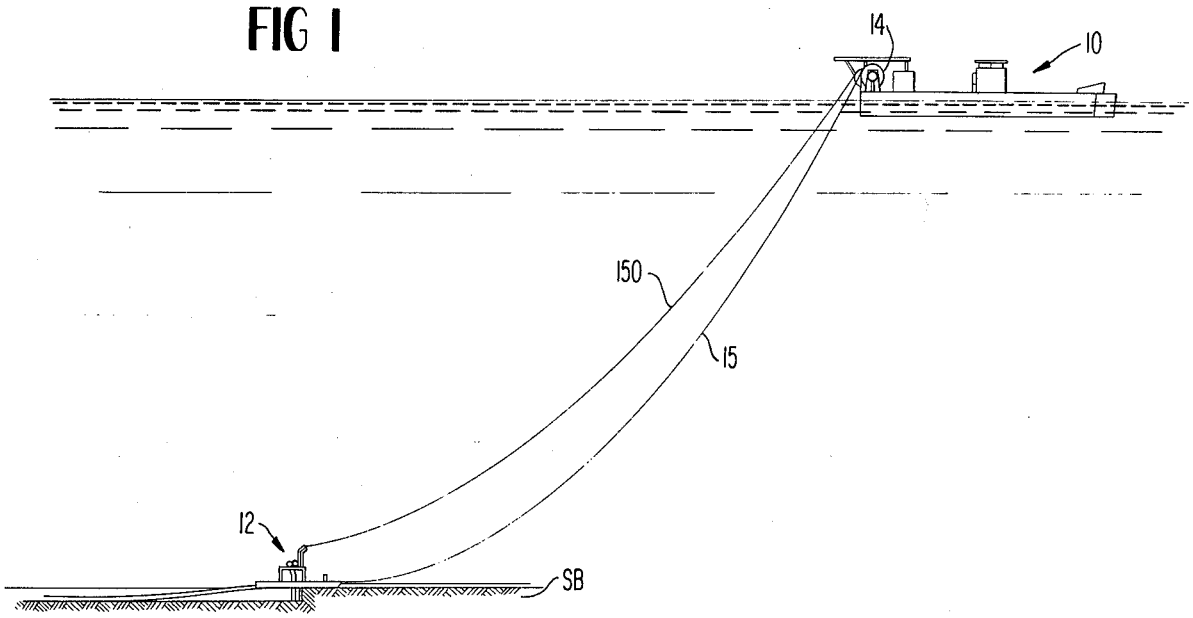
FIG. 1 is a schematic illustration of a tender barge for handling the sea sled and eductor system of the present invention and illustrating the latter in use on the sea bottom.

Referring now to FIG. 1, there is illustrated a towing barge, generally designated 10, for towing a sea sled, generally designated 12. The barge 10 carries on it at least one winch and reel assembly 14 for reeling in or paying out a tow cable 15 connected to the sled 12. The barge also carries a further winch and reel assembly (not shown) for similarly controlling the length of air and water supply hoses and other umbilicals, generally shown as a single umbilical 150, connected between the barge 10 and sled 12. Further details of the tender barge 10 are not believed necessary since the tender barge 10, per se, forms no part of the present invention. It is believed sufficient to note that the tender barge 10 serves to transport the sea sled to and from the work site, to tow the sea sled 12 along the sea bottom designated SB in FIG. 1 during entrenching and pipeline burying operations, and to provide a surface floating carrier for personnel and equipment necessary to the operation of the sea sled and eductor system as described hereinafter. In commercial practice to date, assignee Santa Fe International Corporation has used a conventional rectangular hull barge which carries winches for anchor chains and water hoses, pumps, etc.; that barge is known in the trade as the "Creek".

Referring now particularly to FIGS. 2–5, sea sled 12 comprises a pair of generally cylindrical, laterally spaced, pontoons 24 structurally interconnected one to the other by a plurality of longitudinally spaced transversely extending trusses 26. Each truss 26 is comprised of vertical and diagonally upstanding members 28 and 30, respectively, and transversely extending member 32 connected between the upper ends of the vertical and diagonal members 28 and 30. Forwardly inclined struts 34 also support the forwardmost pair of trusses 26 while rearwardly inclined struts 36 support the aft truss 26. It will be appreciated that the foregoing described structure of the sled provides a clear area between the pontoons 24 whereby the pontoons are adapted to straddle a pipline disposed on the sea bottom for reasons which will be appreciated from the ensuing description. The pontoons are compartmented and suitable valves are provided whereby the pontoons can be ballasted and deballasted.

A pair of transversely spaced, vertically extending, risers 40 upstand from each of the transverse members 32 of the aft and intermediate trusses 26 for supporting the entrenching and eductor apparatus, generally designated 41, carried by sled 12. A cross-over brace 42 interconnects the upper ends of the risers 40 carried by the intermediate truss 26. Additional bracing for the aft risers 42 is provided by diagonally extending struts 44.

The entrenching and eductor apparatus 41 are carried by risers 40 for location at selected elevations relative to the sled. To accomplish this, the support for entrenching and eductor apparatus 41 is provided by a generally rectangular frame (FIG. 3) comprised of a pair of longitudinally extending frame members 46 and transversely extending frame members 48 interconnecting the opposite ends of members 46. A pair of lugs 50 project forwardly from the opposite ends of forward cross member 48 and a similar pair of lugs 52 project rearwardly from the opposite ends of aft cross member 48. Along the aft side of each forward riser 40 and along the forward side of each aft riser 40 there is provided a pair of laterally spaced, vertically extending plates 60 having laterally registering vertically spaced openings 62 therealong. Gusset plates 64 are disposed between each pair of openings 62 to reinforce plates 60 and risers 40. The lugs 50 and 52 are disposed within the slots formed by the pairs of plates 60 in the forward and aft pairs of risers 40, respectively, and lugs 50 and 52 have openings which register with the openings 62.

A pair of laterally spaced longitudinally extending support tubes 68 are secured at opposite ends to members 48. Support tubes 68 are secured to transversely extending members 48 by clamps 74 which permit support tubes 68 to be positioned at selected transversely adjusted positions along members 48 for purposes as will become apparent from the ensuing description. Alternatively, a similar arrangement (not shown) of spaced openings and re-inforcing plates may be provided on transverse members 48 and cooperating lugs provided on support tubes 68 to permit transverse adjustments of the entrenching and eductor apparatus.

The frame, comprised of members 46, 48, and 68, and which rigidly supports the entrenching and eductor apparatus 41, may be selectively positioned along risers 40 at desired elevations by inserting bolts or pins 63 through the openings 62 of plates 60 and the registering openings of the lugs 50 and 52 as applicable.

Figure 6:
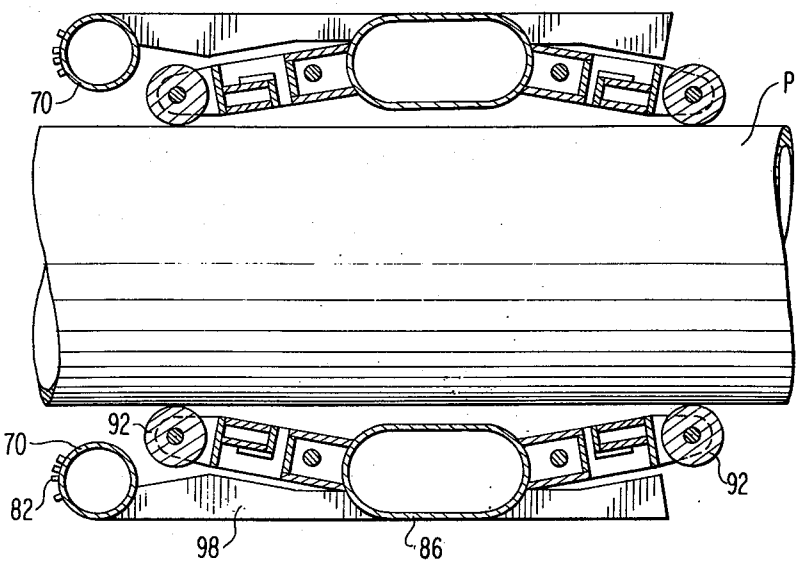
FIG. 6 is an enlarged fragmentary cross-sectional view thereof taken generally about on line 6—6 in FIG. 2.
Figure 3:
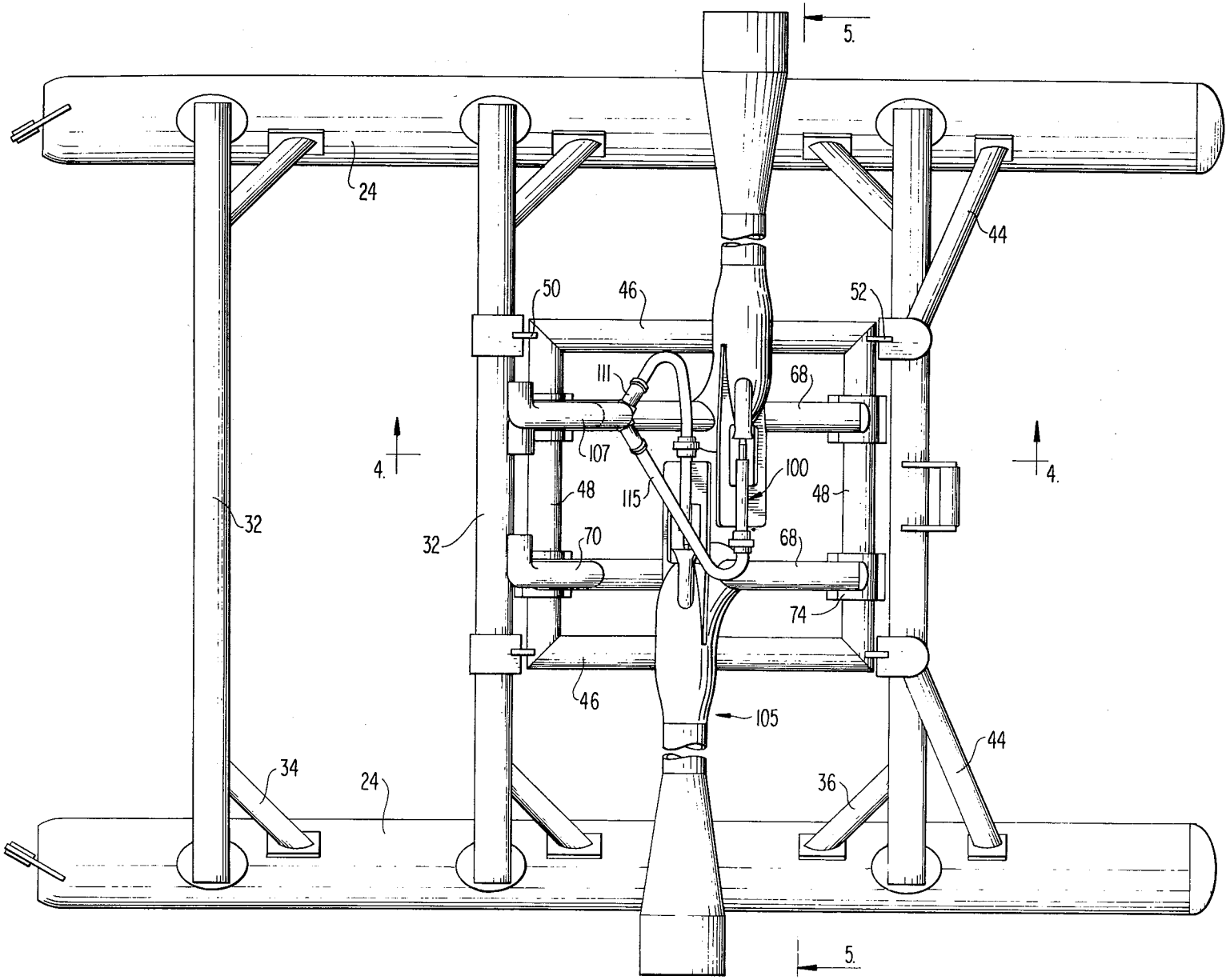
FIG. 3 is an enlarged top plan view thereof.
Figure 4:
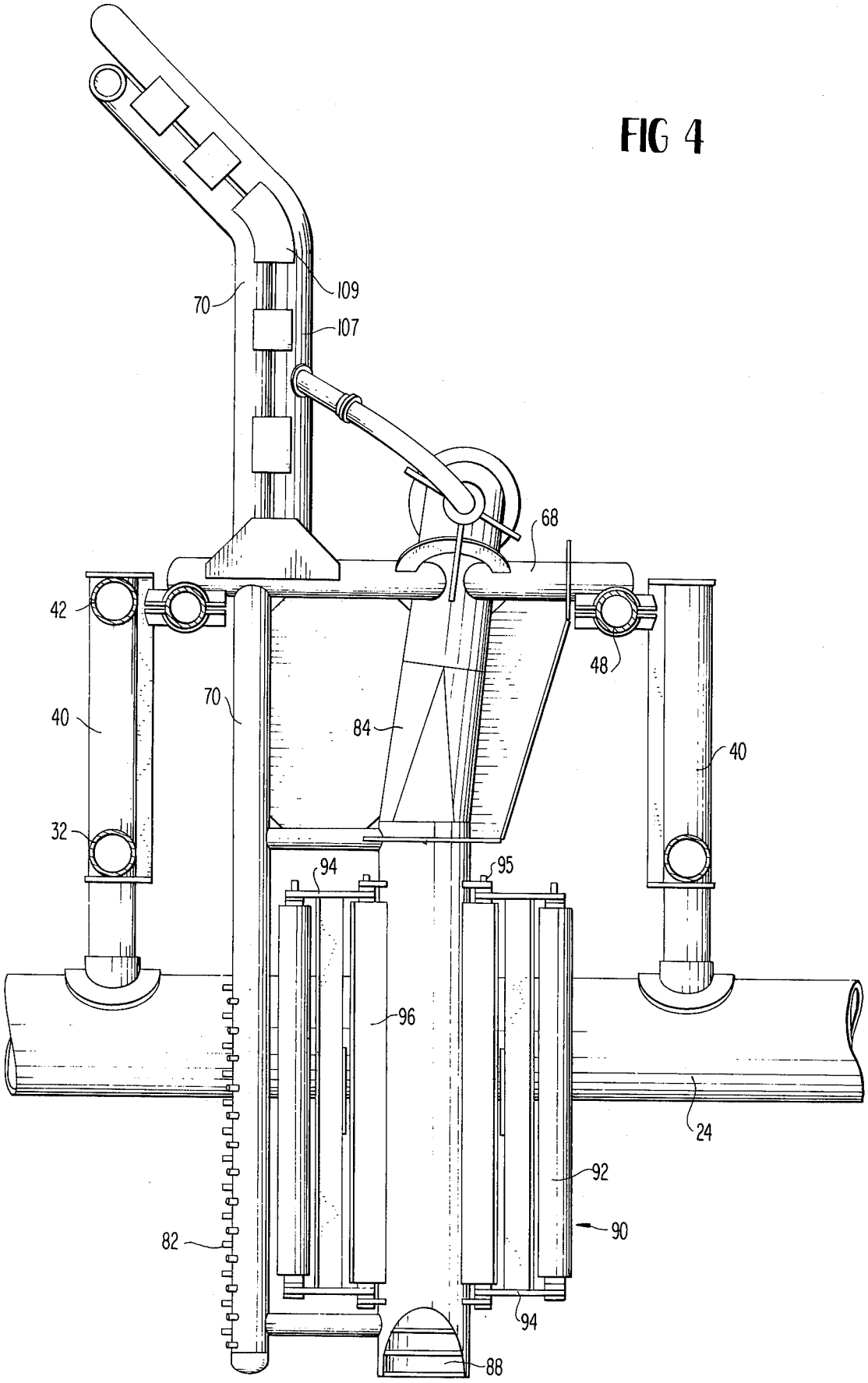
FIG. 4 is an enlarged fragmentary cross-sectional view taken generally about on line 4—4 in FIG. 3.
Figure 5:
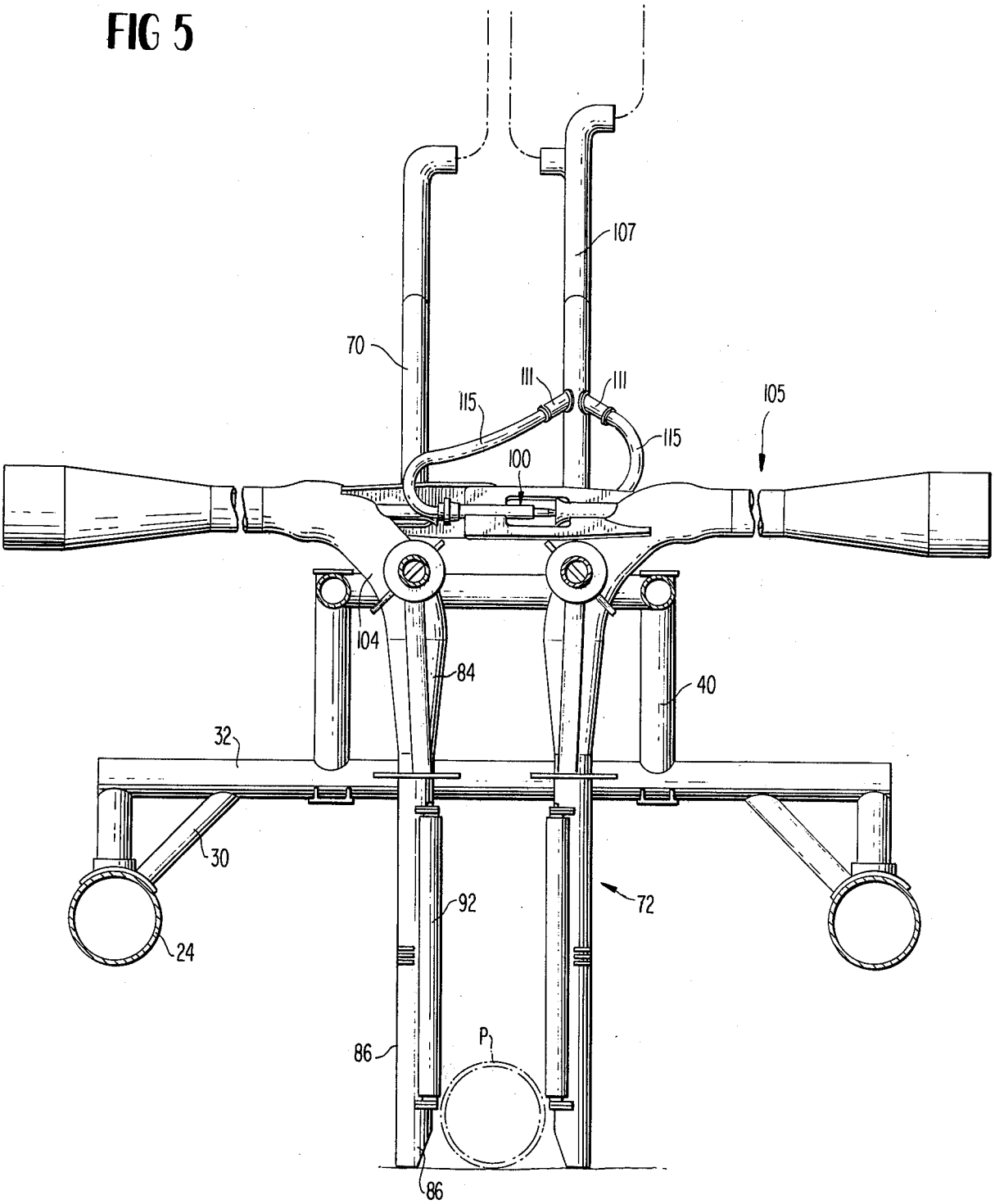
FIG. 5 is an enlarged end elevational view thereof.
Figures 7, 8, 9A, 9B:
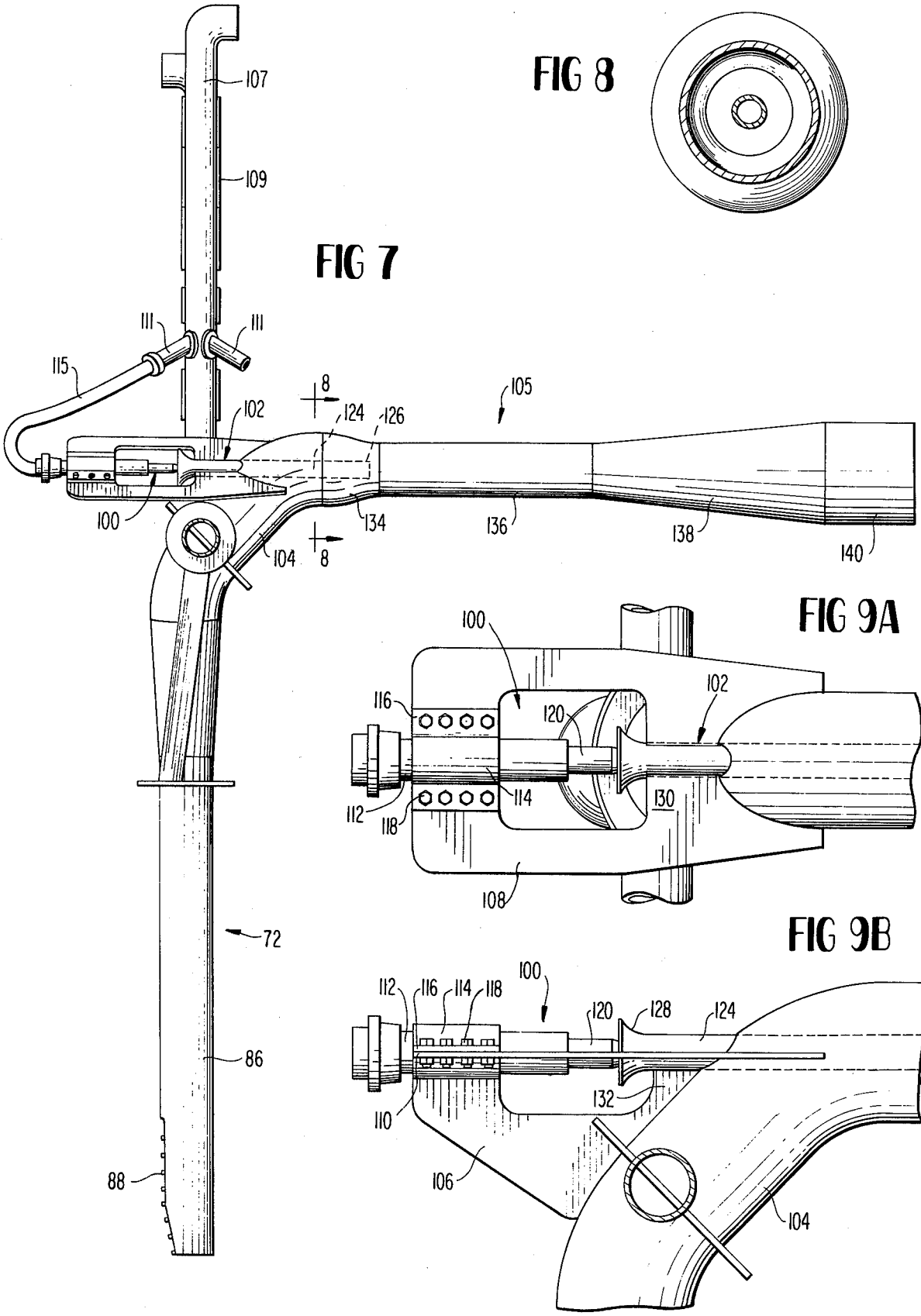
FIG. 7 is an enlarged side elevational view of a portion of the eductor system with parts broken out and in cross section for ease of illustration.
FIG. 8 is a cross-sectional view thereof taken generally about on line 8—8 in FIG. 7.
FIG. 9A is a top plan view of the jet pump mounting arrangement.
FIG. 9B is a side view of the jet pump mounting arrangement.

The entrenching and eductor apparatus 41 is comprised of parts, for example jet tube pipes 70 and suction tubes 72 and other equipment, which are duplicated on opposite sides of sea sled 12 (excepted as otherwise noted); therefore a description of the apparatus on one side of the sled will suffice as a description of both. Referring now particularly to FIGS. 4 and 6, the upper end of each jet tube 70 inclines upwardly and in a forward direction for connection with fluid lines connected at their opposite end to the tender barge 10 whereby fluid under pressure from tender barge 10 is pumped through tubes 70. Each jet tube 70 is structurally interconnected with the suction tube 72 on the like side of the sled by support tubes 68 and carries along its forward edge a plurality of jet nozzles 82 for ejecting the high pressure fluid flowing into tube 70 from tender barge 10 forwardly of the sled. The jet tubes 70 extend below pontoons 24 a distance approximating the depth of the trench to be dug for the pipeline. The nozzles 82 are spaced vertically along the tubes 70 such that they lie at elevations coincident with and below pontoons 24. Nozzles 82 are also spaced circumferentially about the tubes 70 and incline downwardly such that high pressure fluid flows in a downward direction both forwardly and inwardly to fluidize the sea bottom ahead of the tubes 70 and thereby form a trench between the jet tubes.

The eductor apparatus includes the suction tube 72 having a transition section 84 at the upper end of a slurry inlet pipe 86 which is substantially oblong in cross-section. The lower end of inlet pipe 86 is provided with an inlet 88 opening along the inner side thereof. Large quantities of the slurry produced by the fluidization of the sea bottom due to the action of jets 82 enters inlet 88 for transmission through the suction pipe 72. Carried by each oblong inlet pipe section 86 is a roller assemblage 90 comprised of a roller 92 on each of the fore and aft sides of inlet pipe section 86. Opposite ends of each vertically disposed roller are carried by links 94 which in turn are pivotally carried by a shaft 95 pivotally mounted to a pivot housing 96. Housing 96 is secured to the inlet tube 86. A plurality of gusset plates 98 are also secured to inlet tube 86 and project in fore and aft directions on opposite sides thereof. The ends of the forward gusset plate 98 are also secured to the jet tube 70 to provide further support therefor. The forward and aft gusset plates carry load cells which interact with the pivotally mounted rollers 92 whereby the load exerted on either side of the sled by the pipeline can be determined.

FIGS. 7, 8, 9A, 9B and 11 illustrate in detail the jet nozzle and jet pump for the eductor system on one side of the sled. Particularly, the eductor system includes a jet nozzle generally indicated 100, and a jet pump, generally indicated 102, the latter being disposed within a 90° elbow section 104 between the transistion section 84 of the suction tube 72 and an eductor or discharge section, generally indicated 105.

The jet nozzle 100 is supported by a bracket 106 extending upwardly from transition section 84 and also by horizontally extending bracket 108 secured to elbow 104. Bracket 106 supports a water supply pipe 112 for jet nozzle 100. Particularly, the outer end of bracket 106 terminates in a pair of flanges 110 on opposite sides of the water supply pipe 112.

An arcuate bracket 114 having lateral flanges 116 on opposite sides thereof overlies the water supply pipe 112 and bolts 118 cooperate with flanges 110 and 116 to secure supply pipe 112 to the support bracket 106. The forward end of the supply pipe 112 terminates in a nozzle holder 120 which, in turn, supports a jet nozzle 122.

The jet nozzle 100 is axially adjustable by loosening the bolts 118 securing flange portions 110 and 116, axially positioning jet nozzle 100 as desired, and retightening the bolts to secure the nozzle holder 120 between brackets 106 and 114. It is a feature of this invention that the outlet end of jet nozzle 122 is disposed within the flared or bell-shaped inlet end portion 128 of jet pump 102.

High pressure, low volume fluid is supplied to each jet nozzle 100 through a main eductor inlet manifold 107 which extends upwardly adjacent one jet tube 70. Inlet manifold 107 is physically connected to jet tube 70 by gusset plates 109. A pair of eductor jet supply nozzles 111 branch off the lower portion of inlet manifold 107 and are connected by flexible hoses 115 to the inlet of the corresponding jet nozzle 100. The main inlet manifold 107 is connected at its other end to a supply hose, which is connected in turn to a pump on the tender barge. In an alternative arrangement, each jet nozzle 100 may be connected through a corresponding hose directly to a pump on the barge, without going through a common manifold.

Jet pump 102 is comprised of an eductor entry pipe 124, the forward end of which comprises an eductor nozzle outlet 126. Eductor entry pipe 124 is secured to the wall of elbow section 104 of outlet pipe 72; the forward end of eductor entry pipe 124 extends into outlet tube 72 such that the forward end 126 is located in a venturi cone section 134 of outlet pipe 72. The rearward end of entry pipe 124 comprises an outwardly flared bell-shaped end portion 128. In addition to being secured to the wall of elbow section 104, jet pump 102 is also secured to inwardly extending flange portions 130 of lateral bracket 108 and to upwardly extending flange portion 132 of upwardly extending bracket 106.

It will be seen that pump 102 is axially aligned with nozzle 100 and that the eductor entry pipe 124 and nozzle 126 are oriented to flow fluid axially through eductor section 105, comprising venturi cone 134, an outlet pipe section 136, an eductor outlet cone 138 and a pipe outlet 140. Also, from FIG. 3, it will be appreciated that the nozzle 100 and pump 102 on each side of the sled are oriented to discharge fluid from outlet 140 to a like side of the sled on which the corresponding pump and nozzle are associated.

It will be appreciated that the sea sled and eductor system hereof are utilized after the pipeline has been laid along the sea bottom and that it is desirable to locate the pipeline within a trench and cover the trench. To accomplish this, the sea sled 12 is ballasted and lowered from the tender barge 10 such that the rollers 92 on the port and starboard eductor assemblies straddle the pipeline P as illustrated in FIG. 6. High pressure fluid, e.g., sea water, is then supplied to the jet tubes 70 from the tender barge 10 through fluid lines 150 (FIG. 1). The high pressure fluid issuing from jets 82 tends to fluidize the sea bottom directly below the pipeline and in front of sled 12. The sled thus sinks to a depth wherein pontoons 24 rest on the sea bottom on opposite sides of the pipeline. The sled is thus ready to be towed by line 15 connected to the bow of the tender barge.

As the barge is towed, high pressure fluid, e.g., sea water, is also supplied to jet nozzles 100 via suitable conduits from the tender barge 10. Each of nozzles 122 supplies a high pressure low volume fluid to the inlet 128 of the jet pump 102. The high pressure fluid exiting from jet nozzle 122 is dissipated to some extent in the larger diameter eductor entry pipe 124. This creates a low pressure region at the inlet portion 128 of the jet pump 102; the resultant suction effect causes ambient fluid to be drawn into the flared or bell-shaped inlet portion 128 around the exterior of jet nozzle 122 to be entrained with the high pressure, low volume fluid supplied from the barge through jet nozzle 100. Thus, the jet nozzle flow and the entrained fluid pass through pump 102 and nozzle 126. This results in a high volume, low pressure flow through nozzle 126 into the venturi cone 134 and the eductor outlet. The flow issuing from the jet pump 102 causes a suction at the inlet opening 86 of pipe 72 whereby slurry produced by the fluidization of the sea bottom by jet nozzles 82 enters inlet 88 and flows upwardly through pipe section 86 of suction tube 72 for delivery from the outlet pipe 140 of eductor section 105 on one side of the trench.

Figure 10A:
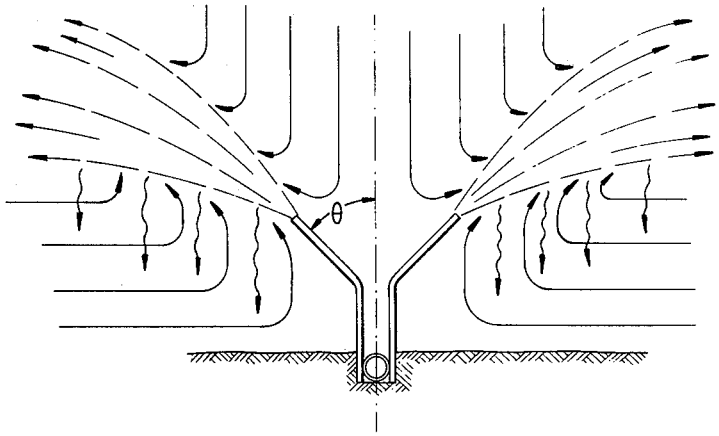
FIGS. 10A and 10B are comparative flow patterns for eductor angles of 45° and 90°, respectively.
Figure 10B:
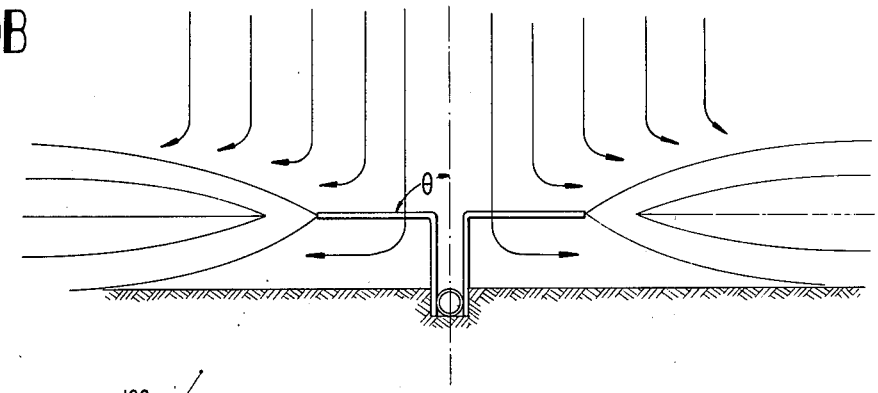

The slurry produced in the manner described above is discharged through eductor section 105 laterally away from the trench in a substantially horizontal direction. FIGS. 10A and 10B depict the discharge flow patterns where the eductor pipe discharges slurry at 45° and 90° angles, respectively relative to the intake of the suction conduit. When the discharge angle $\theta = 45°$ (FIG. 10A), discharge entrainment flow is from all directions, including backflow along the bottom towards the trench. This self-created current transports discharged slurry and/or bottom sediment back toward the excavation. Obviously, the efficiency of the trenching system is reduced by this effect. Referring to FIG. 10B, it will be seen that a horizontal discharge changes the entrainment flow pattern such that all flow is substantially away from the trench; this pattern substantially prevents the back currents found in the 45° discharge pattern from occurring with a consequent reduction and substantial elimination of material being drawn back into the excavation.

In a preferred embodiment of the present invention supply fluid is provided from the barge to each jet pump at a rate of 2000 gpm and a pressure of 2500 psi. The jet pump inlet section 128 has a maximum diameter of 12 inches with a flare whose radius R is 6 inches; the jet pump throat has an inside diameter $D_1 = 4\frac{1}{2}$ inches. The jet nozzle outlet 122 has an inside diameter $D_2$ of approximately 1 inch. The suction tube 72 is oblong with a long axis of $2\frac{1}{2}$ feet, the radius of the end portions being typically 17 inches; the elbow 104 is 24 inches in diameter with a 90° bend. The venturi cone 136 is 16 inches long and provides a transition from a 24 to an 18 inch diameter, the outlet pipe section 136 is 9 feet 2 inches long and has an inside diameter $D_3$ of 18 inches. The eductor outlet cone 138 is 7 feet long and forms a transition from 18 to 34 inches in diameter, and the outlet pipe 140 is 2 feet 8 inches long with a 34 inch diameter. Preferably, the jet pump nozzle exit lies axially at a location intermediate the venturi cone and approximately $4\frac{1}{2}$ inches from the smaller diameter end. The height of the suction tube 72 from the bottom of the inlet 88 to the center line of the eductor section 105 is 22 feet; the length of the eductor section 105 from the end of outlet pipe 140 to the center line of suction tube 72 is 24 feet 7 inches.

Figure 11:
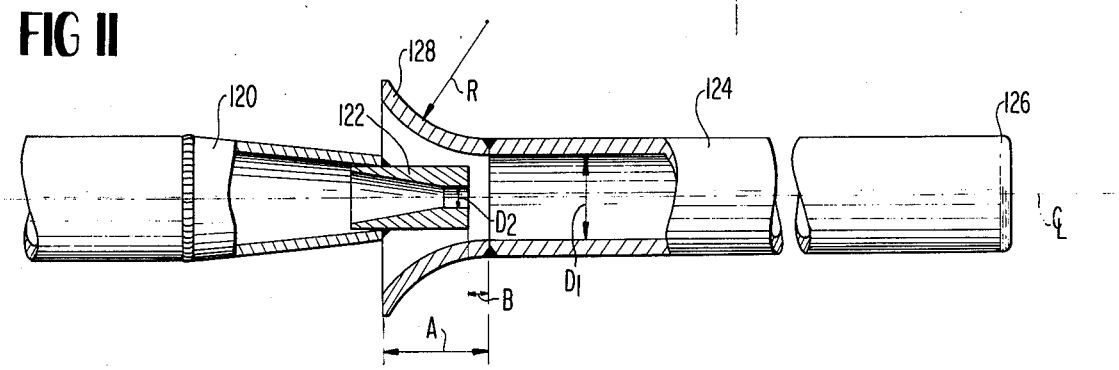
FIG. 11 is an enlarged side sectional view of the jet pump nozzles.
Figure 2:
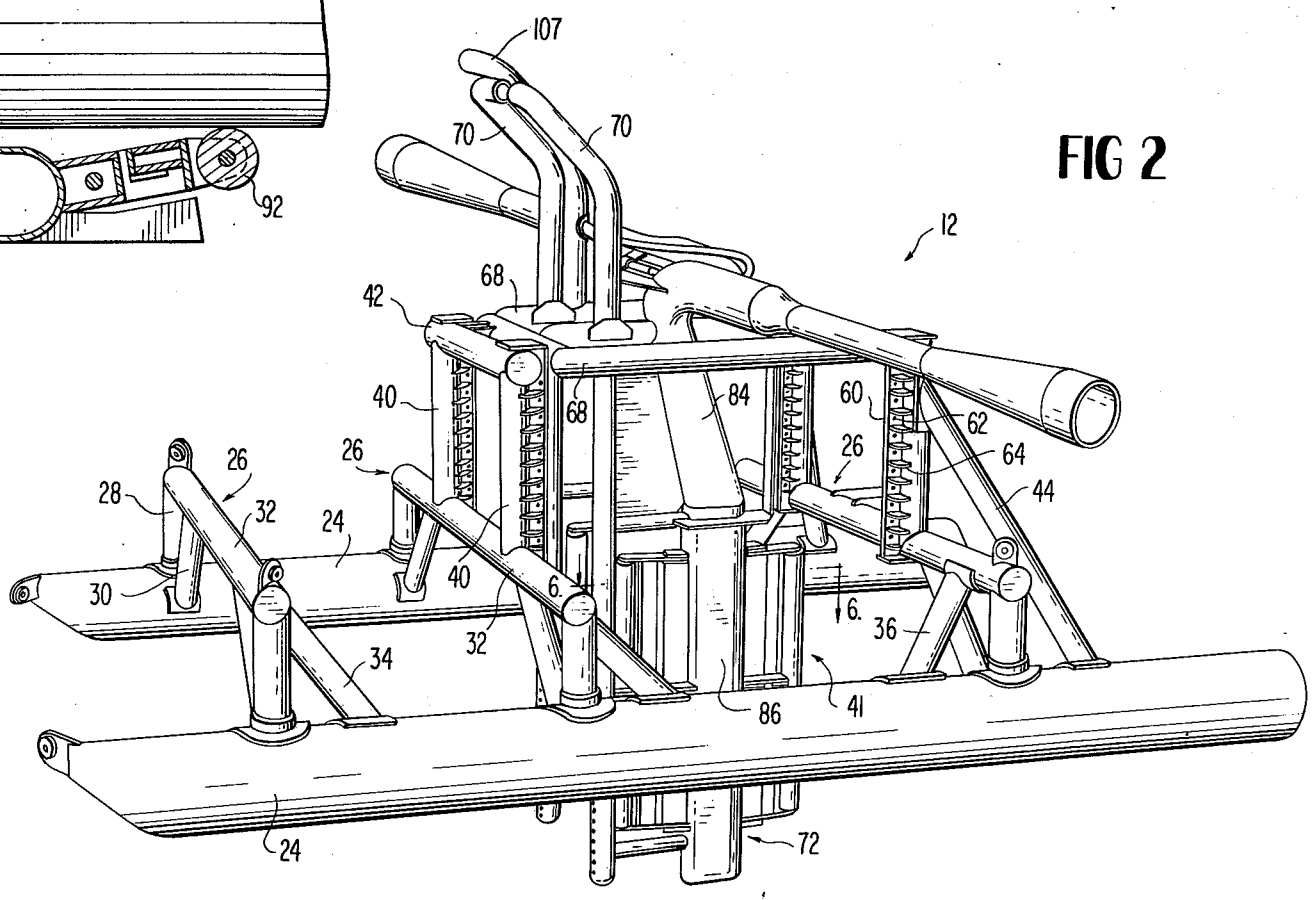
FIG. 2 is a perspective view of the sea sled and eductor system constructed in accordance with the present invention.

Referring particularly to FIG. 11, it will be seen that certain dimensions and relationships between the primary jet nozzle 100 and jet pump 102 are highly significant. Thus the preferred ratio of $D_1$ (the inside diameter of eductor entry pipe 124) and $D_2$ (the inside diameter of jet nozzle 122) is at least 4:1. Also the ratio between the diameter $D_3$ of outlet section 135 and diameter $D_1$ of eductor entry pipe 124 is in the range of preferably between 4:1 and 3:1.

The inside diameter $D_1$ of eductor entry pipe 124 is preferably in a range of from 3 to 6 inches, depending on the volume of the pump and other factors. In commercial use, high pressure, low volume fluid is supplied from the barge at a rate of approximately 2000 gpm (gallons per minute) at a pressure of about 2500 psi. Under these conditions, $D_1$ is preferably about $4\frac{1}{2}$ inches. The radius R of the bell-shaped end 128 of jet pump 102 is also a function of a number of factors, including the pressure of the pump supply fluid, the amount of entrainment desired, etc. For a jet pump diameter $D_1$ of $4\frac{1}{2}$ inches, R is preferably 6 inches. The length A of a 6 inch radius bell 128 is preferably $5\frac{1}{2}$ inches, where A is the axial distance between the outlet end of bell 128 and a plane perpendicular to the longitudinal axis ℄ of jet pump 102 containing the axis of rotation of radius R.

The outlet end of jet nozzle 122 is adjustable with respect to the smaller end of bell 128 to optimize the efficiency of the jet pump. Efficiency is a function of the taper of jet nozzle 122, the radius of bell 128, diameters $D_1$ and $D_2$ of the eductor entry pipe 124 and jet nozzle 122, respectively, and the distance B between the outlet end of jet nozzle 122 and smaller end of bell 128. For the preferred dimensions set forth above, i.e. $D_1 = 4\frac{1}{2}$ inches, $D_1:D_2 = 4:1$, $R = 6$ inches, and a pump flow rate of approximately 2000 gpm at 2500 psi, distance B is preferably $1\frac{1}{4}$ inches. As the outlet end of jet nozzle 122 moves closer to the small end of bell 128 ($B \rightarrow 0$) the effect of cavitation increases; the bubbling effect due to cavitation causes excessive wear on the jet pump elements. Conversely, as the outlet end jet nozzle 122 is moved away from the small end of bell 128 (B → e.g. 5½ inches), the efficiency of the jet pump decreases significantly.

Since prior airlift systems for removal of slurries are not satisfactory for use in depths beyond 150–200 feet and low volume high, pressure water systems are presently available to supply an eductor from a tender barge, the present invention utilizes and arranges the above-described novel jet nozzle and pump in a manner to advantageously fully utilize such available low volume, high pressure water to remove a predetermined quantity of slurry from the trench. As noted previously, a high pressure water jet is necessary to generate the required lifting or suction capacity. However, utilization of a high pressure water jet to accomplish the desired flow rate would cause severe cavitation problems. The jet nozzle and pump arrangement disclosed herein solves these problems while maintaining desired flow rates and pressures. Particularly, by permitting the fluid from the high pressure jet to expand in the jet pump nozzle to reduce the pressure and at the same time entrain surrounding ambient fluid or sea water whereby the high energy available is reduced, the desired removal rates can be obtained with the cavitation problem minimized or eliminated. For example, the sea sled and eductor system hereof is adapted for use with available equipment which provides 2000 gallons per minute and 2500 pounds pressure at the operating depth. With this available power, the sea sled can remove over 38,000 gallons per minute of slurry from the trench at a depth of 280 feet.

It has been found that the jet pump of the present invention substantially improves the already successful functioning of the jet pump of the U.S. Pat. No. 3,877,238. With the pump described in the U.S. Pat. No. 3,877,238, energy is lost due to the dissipation of high pressure, low volume fluid into the surrounding water as the jet expands in the space between the outlet of the primary nozzle and the inlet of the jet pump nozzle. The apparatus of the present invention directs substantially all of the high pressure, low volume fluid from the outlet of jet nozzle 122 into jet pump 102. By properly sizing and orienting the several members comprising the jet pump assembly, the high pressure low volume fluid supplied from the surface pumps through the conduits and eductor inlet manifold described above, is reduced in pressure in jet pump 102 while at the same time entraining ambient fluid through bell-shaped inlet 128. The flow rate at outlet 126 is increased almost 54% compared to the system of the U.S. Pat. No. 3,877,238. More significantly, the flow rate at discharge outlet 140 is increased almost 77%. The flow rate at the intake suction tube 86 is increased almost 87% with the jet pump apparatus of this invention. Table I shows the flow rates (in gallons per minute) for the jet pump described in the U.S. Pat. No. 3,877,238 and the jet pump of this invention; the dimemsions of the several suction tube, eductor, and jet pump sections are also indicated. Although the values given are for a clear water test, the percentage comparison is valid for the case in which the suction tube is used to draw in slurry as part of a pipe trenching operation.

TABLE I

| | Comparative flow rates. | | | |
|---|---|---|---|---|
| | Flow Rate × $10^3$ gpm | | Percentage | Diameter |
| Section | (New) | (Old) | Change | (inches) |
| 86 | 28.0 | 15.0 | + 86.6 | 15.25 × 29.25 |
| 72 | 28.0 | 15.0 | + 86.6 | 23.25 |
| 100 | 2.0 | 2.0 | — | 1.25 |
| 102 | 10.0 | 6.5 | + 53.8 | 4.5 |
| 136 | 38.0 | 21.5 | + 76.7 | 15.25 |
| 140 | 38.0 | 21.5 | + 76.7 | 31.25 |

It will be appreciated that certain of the prior pipe burying systems require two sets of pumps on the lay barge. One set of high pressure fluid pumps is utilized for the jetting nozzles while another set is utilized for use with the eductor system. The present invention, however, utilizes high pressure fluid emanating from a single pump source for both the jetting and eductor systems. The configuration of the eductor hereof is such that the pump requirements therefor are altered to the same as required for the jetting action. That is, the high pressure fluid delivered to the eductor system is transformed to the necessary low pressure through the foregoing described nozzle arrangement.

The foregoing described sea sled has been utilized in actual pipe entrenching and burying operations in the North Sea. In operation, the sea sled is preferably towed from the tender barge 10 by a tow line 15 connected to the bow of the sea sled. The fluid lines 150 provide the high pressure fluid from the tender barge to the jets and to the eductor system.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. Apparatus for use in making a trench in a sea bottom and for removing spoil formed during making such a trench, said apparatus including: at least one suction tube having a bent portion merging with an eductor tube section; a jet pump associated with said suction tube and comprising first and second nozzles which are arranged substantially coaxially in tandem, the first nozzle projecting through a side of said suction tube into the bent portion in the direction of the outlet of the eductor tube section, the second nozzle having an outlet end located within and radially spaced from an inlet section of the first nozzle such that said first nozzle is intended to be in communication with ambient water during a trenching operation, and means for supplying high pressure water to said second nozzle to cause said water supply to flow through said nozzles to entrain ambient water and to cause spoil produced during the trenching operation to flow through the suction tube to be entrained with said water supply and ambient water and discharged through the eductor tube section.

2. Apparatus according to claim 1, wherein the axis of said eductor tube section is located at an angle of approximately 90° relative to the axis of said suction tube.

3. Apparatus according to claim 2, wherein the eductor tube section is disposed to discharge spoil drawn into the suction tube in a direction substantially parallel to the surface of the sea bottom.

4. Apparatus for use in making a trench in a sea bottom and for removing spoil formed during making such a trench, said apparatus including: at least one suction tube having a bent portion merging with an eductor tube section; a jet pump associated with said suction tube and comprising first and second nozzles which are arranged substantially coaxially in tandem, the first nozzle projecting through a side of said suction tube into the bent portion substantially coaxially with the eductor tube section, the second nozzle having an outlet end located within and radially spaced from an inlet section of the first nozzle such that said first nozzle is intended to be in communication with ambient water during a trenching operation, and means for supplying high pressure water to said second nozzle to cause said water supply to flow through said nozzles to entrain ambient water and to cause spoil produced during the trenching operation to flow through the suction tube to be entrained with said water supply and ambient water and discharged through the eductor tube section.

5. Apparatus according to claim 4, wherein the axis of said eductor tube section is located at an angle of approximately 90° relative to the axis of said suction tube.

6. Apparatus according to claim 4, wherein the eductor tube section is disposed to discharge spoil drawn into the suction tube in a direction substantially parallel to the surface of the sea bottom.

7. Apparatus for use in making a trench in a sea bottom and for removing spoil formed during making such a trench, said apparatus including: at least one outlet nozzle with means for receiving and emitting a supply of high pressure water for production of a trench by jetting; at least one suction tube associated with said at least one outlet nozzle, said suction tube having a bent portion merging with an eductor tube section; a jet pump associated with said suction tube and comprising first and second nozzles which are arranged substantially coaxially in tandem, the first nozzle projecting through a side of said suction tube into the bent portion in the direction of the outlet of the eductor tube section, the second nozzle having an outlet end located within and radially spaced from an inlet section of the first nozzle such that said first nozzle is intended to be in communication with ambient water during a trenching operation; and means for supplying high pressure water to said second nozzle to cause said water supply to flow through said nozzles to entrain ambient water and to cause spoil produced by the action of said outlet nozzle during the trenching operation to flow through the suction tube to be entrained with said water supply and ambient water and discharged through the eductor tube section.

8. Apparatus according to claim 7, wherein the axis of said eductor tube section is located at an angle of approximately 90° relative to the axis of said suction tube.

9. Apparatus according to claim 8, wherein the eductor tube section is disposed to discharge spoil drawn into the suction tube in a direction substantially parallel to the surface of the sea bottom.

10. Apparatus for use in making a trench in a sea bottom and for removing spoil formed during making use a trench, said apparatus including: first and second outlet nozzles with means for receiving and emitting a supply of high pressure water for production of a trench by jetting; first and second suction tubes associated with said first and second outlet nozzles, respectively, each said suction tube having a bent portion merging with an associated eductor tube section; first and second jet pumps associated with said first and second suction tubes, respectively, each said jet pump comprising first and second nozzles which are arranged substantially coaxially in tandem, each said first nozzle projecting through a side of its associated suction tube into the bent portion substantially coaxially with the eductor tube section, each said second nozzle having an outlet end located within and radially spaced from an inlet section of the corresponding first nozzle such that said first nozzles are intended to be in communication with ambient water during a trenching operation; and means associated with each second nozzle for receiving a high pressure supply of water to cause said water supply to flow through said nozzles to entrain ambient water and to cause spoil produced during a trenching operation to flow through the suction tubes to be entrained with said water supply and ambient water and discharged through the eductor tube sections.

11. Apparatus according to claim 10, wherein the axis of said eductor tube section is located at an angle of approximately 90° relative to the axis of said suction tube.

12. Apparatus according to claim 11, wherein the eductor tube section is disposed to discharge spoil drawn into the suction tube in a direction substantially parallel to the surface of the sea bottom.

13. Apparatus for use in making a trench in a sea bottom and for removing spoil formed during making such a trench, said apparatus comprising in combination:

a surface floating vessel; a tow for excavating a trench for a pipeline to be laid along the sea bottom and for removing the spoil formed by the excavation, said tow having a base structure adapted to slide on the sea bottom; means carried by said vessel for raising and lowering the tow, respectively, from and to the sea bottom; means carried by said tow for excavating the trench and including outlet nozzles with means for receiving from the vessel a high pressure supply of water and for emitting said high pressure water supply through said nozzles for production of a trench by jetting;

means carried by said tow for removing the spoil, said spoil removing means being in duplicate and being supported by the tow to be in substantially side by side relationship relative to the direction of slide of the tow, each spoil removing means comprising: a suction tube associated with one of said outlet nozzles, each suction tube having a bent portion merging with an eductor tube section at an angle of approximately 90°; a jet pump associated with each said suction tube, each said jet pump comprising first and second nozzles which are arranged substantially coaxially in tandem, each first nozzle projecting through a side of its associated suction tube into the bent portion substantially coaxially with the eductor tube section, each second nozzle having an outlet and located within and radially spaced from an inlet section of the corresponding first nozzle such that said first nozzle is intended to be in communication with ambient water during a trenching operation; and means associated with each second nozzle for receiving said high pressure water supply from the vessel;

guide means carried by said base structure for maintaining said tow in alignment with the pipeline as the trench is excavated and adapted to straddle the pipeline; a frame for supporting said trenching means, said spoil removal means and said guide means; and means for adjusting the elevation of said frame relative to said base structure thereby to adjust the elevation of said nozzles, said suction tube inlets and said guide means relative to said base structure;

each of said suction tube inlets having an aperture opening in a lateral inward direction relative to the longitudinal sides of the tow, with said apertures lying in substantial lateral register one with the other; and means mounting each of said first and second nozzles for movement into selected position axially relative to one another.

14. Apparatus according to claim 13, wherein the inlet section of each first nozzle is bell-shaped, the curvature of the bell shape being defined by a radius R, the smaller end of the bell being continguous with the main body of the first nozzle such that the smaller end of the bell has an opening which is the same size as the internal dimensions of the main body of the first nozzle, the smaller end of the bell lying in a plane which is perpendicular to the longitudinal axis of the first nozzle and which contains the axis of rotation of radius R, said bell-shaped inlet section having a length A between its smaller and larger ends; and wherein the outlet end of each second nozzle is located a distance B from the smaller end of the bell-shaped inlet section, where $0 < B < A$.

15. Apparatus according to claim 14, wherein each said first nozzle has an inside diameter $D_1$ and each said second nozzle has an inside diameter $D_2$, where $D_1:D_2 > 4:1$.

16. Apparatus according to claim 15, wherein the outlet section of said suction tube has a diameter $D_3$, where $D_3:D_1$ is in the range of approximately 3:1 to 4:1.

17. Apparatus according to claim 15, wherein $D_1$ is in the range of from 3 inches to 6 inches.

18. Apparatus according to claim 17, wherein $D_1$ is approximately 4½ inches.

19. Apparatus according to claim 18, wherein R is approximately 6 inches.

20. Apparatus according to claim 14, wherein A is approximately 5½ inches.

21. Apparatus according to claim 19, wherein B is approximately 1¼ inches.

22. Apparatus according to claim 13, wherein the axis of said eductor tube section is located at an angle of approximately 90° relative to the axis of said suction tube.

23. Apparatus according to claim 22, wherein the eductor tube section is disposed to discharge spoil drawn into the suction tube in a direction substantially parallel to the surface of the sea bottom.

24. Apparatus for use in making a trench in a sea bottom and for removing spoil formed during making such a trench, said apparatus including: at least one suction tube having a bent portion merging with an eductor tube section; a jet pump associated with said suction tube and comprising first and second nozzles which are arranged substantially coaxially in tandem, the first nozzle projecting through a side of said suction tube into the bent portion in the direction of the outlet of the eductor tube section, the second nozzle having an outlet end located within and radially spaced from an inlet section of the first nozzle such that said first nozzle is intended to be in communication with ambient water during a trenching operation, and means for supplying high pressure water to said second nozzle to cause said water supply to flow through said nozzles to entrain ambient water and to cause spoil produced during the trenching operation to flow through the suction tube to be entrained with said water supply and ambient water and discharged through the eductor tube section; wherein the inlet section of the first nozzle is bell-shaped, the curvature of the bell-shape being defined by a radius R, the smaller end of the bell being contiguous with the main body of the first nozzle such that the smaller end of the bell has an opening which is the same size as the internal dimensions of the main body of the first nozzle, the smaller end of the bell lying in a plane which is perpendicular to the longitudinal axis of the first nozzle and which contains the axis of rotation of radius R, said bell-shaped inlet section having a length A between its smaller and larger ends; and wherein the outlet end of the second nozzle is located a distance B from the smaller end of the bell-shaped inlet section, where $0<B<A$.

25. Apparatus according to claim 24, wherein the axis of said eductor tube section is located at an angle of approximately 90° relative to the axis of said suction tube.

26. Apparatus according to claim 25, wherein the eductor tube section is disposed to discharge spoil drawn into the suction tube in a direction substantially parallel to the surface of the sea bottom.

27. Apparatus according to claim 24, wherein said first nozzle has an inside diameter $D_1$ and said second nozzle has an inside diameter $D_2$, where $D_1:D_2 > 4:1$.

28. Apparatus according to claim 27, wherein the outlet section of said suction tube has a diameter $D_3$, where $D_3:D_1$ is in the range of approximately 3:1 to 4:1.

29. Apparatus according to claim 27, wherein $D_1$ is in the range of from 3 inches to 6 inches.

30. Apparatus according to claim 29, wherein $D_1$ is approximately 4½ inches.

31. Apparatus according to claim 30, wherein R is approximately 6 inches.

32. Apparatus according to claim 24, wherein A is approximately 5½ inches.

33. Apparatus according to claim 32, wherein B is approximately 1¼ inches.

34. Apparatus for use in making a trench in a sea bottom and for removing spoil formed during making such a trench, said apparatus including: at least one suction tube having a bent portion merging with an eductor tube section; a jet pump associated with said suction tube and comprising first and second nozzles which are arranged substantially coaxially in tandem, the first nozzle projecting through a side of said suction tube into the bent portion substantially coaxially with the eductor tube section, the second nozzle having an outlet end located within and radially spaced from an inlet section of the first nozzle such that said first nozzle is intended to be in communication with ambient water during a trenching operation, and means for supplying high pressure water to said second nozzle to cause said water supply to flow through said nozzles to entrain ambient water and to cause spoil produced during the trenching operation to flow through the suction tube to be entrained with said water supply and ambient water and discharged through the eductor tube section; wherein the inlet section of the first nozzle is bell-shaped, the curvature of the bell-shape being defined by a radius R, the smaller end of the bell being contiguous with the main body of the first nozzle such that the smaller end of the bell has an opening which is the same size as the internal dimensions of the main body of the first nozzle, the smaller end of the bell lying in a plane which is perpendicular to the longitudinal axis of the first nozzle and which contains the axis of rotation of radius R, said bell-shaped inlet section having a length A between its smaller and larger ends; and wherein the outlet end of the second nozzle is located a distance B from the smaller end of the bell-shaped inlet section, where $0<B<A$.

35. Apparatus according to claim 34, wherein the axis of said eductor tube section is located at an angle of approximately 90° relative to the axis of said suction tube.

36. Apparatus according to claim 35, wherein the eductor tube section is disposed to discharge spoil drawn into the suction tube in a direction substantially parallel to the surface of the sea bottom.

37. Apparatus according to claim 34, wherein said first nozzle has an inside diameter $D_1$ and said second nozzle has an inside diameter $D_2$, where $D_1:D_2 > 4:1$.

38. Apparatus according to claim 37, wherein the outlet section of said suction tube has a diameter $D_3$, where $D_3:D_1$ is in the range of approximately 3:1 to 4:1.

39. Apparatus according to claim 37, wherein $D_1$ is in the range of from 3 inches to 6 inches.

40. Apparatus according to claim 39, wherein $D_1$ is approximately 4½ inches.

41. Apparatus according to claim 40, wherein R is approximately 6 inches.

42. Apparatus according to claim 34, wherein A is approximately 5½ inches.

43. Apparatus according to claim 41, wherein B is approximately 1¼ inches.

44. Apparatus for use in making a trench in a sea bottom and for removing spoil formed during making such a trench, said apparatus including: at least one outlet nozzle with means for receiving and emitting a supply of high pressure water for production of a trench by jetting; at least one suction tube associated with said at least one outlet nozzle, said suction tube having a bent portion merging with an eductor tube section; a jet pump associated with said suction tube and comprising first and second nozzles which are arranged substantially coaxially in tandem, the first nozzle projecting through a side of said suction tube into the bent portion in the direction of the outlet of the eductor tube section, the second nozzle having an outlet end located within and radially spaced from an inlet section of the first nozzle such that said first nozzle is intended to be in communication with ambient water during a trenching operation; and means for supplying high pressure water to said second nozzle to cause said water supply to flow through said nozzles to entrain ambient water and to cause spoil produced by the action of said outlet nozzle during the trenching operation to flow through the suction tube to be entrained with said water supply and ambient water and discharged through the eductor tube section; wherein the inlet section of the first nozzle is bell-shaped, the curvature of the bell-shape being defined by a radius R, the smaller end of the bell being contiguous with the main body of the first nozzle such that the smaller end of the bell has an opening which is the same size as the internal dimensions of the main body of the first nozzle, the smaller end of the bell lying in a plane which perpendicular to the longitudinal axis of the first nozzle and which contains the axis of rotation of radius R, said bell-shaped inlet section having a length A between its smaller and larger ends; and wherein the outlet end of the second nozzle is located a distance B from the smaller end of the bell-shaped inlet section, wherein $0<B<A$.

45. Apparatus according to claim 44, wherein the axis of said eductor tube section is located at an angle of approximately 90° relative to the axis of said suction tube.

46. Apparatus according to claim 45, wherein the eductor tube section is disposed to discharge spoil drawn into the suction tube in a direction substantially parallel to the surface of the sea bottom.

47. Apparatus according to claim 44, wherein said first nozzle has an inside diameter $D_1$ and said second nozzle has an inside diameter $D_2$, where $D_1:D_2 > 4:1$.

48. Apparatus according to claim 47, wherein the outlet section of said suction tube has a diameter $D_3$, where $D_3:D_1$ is in the range of approximately 3:1 to 4:1.

49. Apparatus according to claim 47, wherein $D_1$ is in the range of from 3 inches to 6 inches.

50. Apparatus according to claim 49, wherein $D_1$ is approximately 4½ inches.

51. Apparatus according to claim 50, wherein R is approximately 6 inches.

52. Apparatus according to claim 44, wherein A is approximately 5½ inches.

53. Apparatus according to claim 52, wherein B is approximately 1¼ inches.

54. Apparatus for use in making a trench in a sea bottom and for removing spoil formed during making such a trench, said apparatus including: first and second outlet nozzles with means for receiving and emitting a supply of high pressure water for production of a trench by jetting; first and second suction tubes associated with said first and second outlet nozzles, respectively, each said suction tube having a bent portion merging with an associated eductor tube section; first and second jet pumps associated with said first and second suction tubes, respectively, each said jet pump comprising first and second nozzles which are arranged substantially coaxially in tandem, each said first nozzle projecting through a side of its associated suction tube into the bent portion substantially coaxially with the eductor tube section, each said second nozzle having an outlet end located within and radially spaced from an inlet section of the corresponding first nozzle such that said first nozzles are intended to be in communication with ambient water during a trenching operation; and means associated with each second nozzle for receiving a high pressure supply of water to cause said water supply to flow through said nozzles to entrain ambient water and to cause spoil produced during a trenching operation to flow through the suction tubes to be entrained with said water supply and ambient water and discharged through the eductor tube section; wherein the inlet section of each first nozzle is bell-shaped, the curvature of the bell-shape being defined by a radius R, the smaller end of the bell being contiguous with the main body of the first nozzle such that the smaller end of the bell has an opening which is the same size as the internal dimensions of the main body of the first nozzle, the smaller end of the bell lying in a plane which is perpendicular to the longitudinal axis of the first nozzle and which contains the axis of rotation of radius R, said bell-shaped inlet section having a length A between its smaller and larger ends; and wherein the outlet end of each second nozzle is located a distance B from the smaller end of the bell-shaped inlet section, where $0<B<A$.

55. Apparatus according to claim 54, wherein the axis of said eductor tube section is located at an angle of approximately 90° relative to the axis of said suction tube.

56. Apparatus according to claim 55, wherein the eductor tube section is disposed to discharge spoil drawn into the suction tube in a direction substantially parallel to the surface of the sea bottom.

57. Apparatus according to claim 54, wherein each said first nozzle has an inside diameter $D_1$ and each said second nozzle has an inside diameter $D_2$, where $D_1:D_2 > 4:1$.

58. Apparatus according to claim 57, wherein the outlet section of each said suction tube has a diameter $D_3$, where $D_3:D_1$ is in the range of approximately 3:1 to 4:1.

59. Apparatus according to claim 57, wherein $D_1$ is in the range of from 3 inches to 6 inches.

60. Apparatus according to claim 59, wherein $D_1$ is approximately $4\frac{1}{2}$ inches.

61. Apparatus according to claim 60, wherein R is approximately 6 inches.

62. Apparatus according to claim 54, wherein A is approximately $5\frac{1}{2}$ inches.

63. Apparatus according to claim 62, wherein B is approximately $1\frac{1}{4}$ inches.

* * * * *